US009647321B2

(12) United States Patent
Park et al.

(10) Patent No.: US 9,647,321 B2
(45) Date of Patent: May 9, 2017

(54) ANTENNA FOR PORTABLE DEVICE

(71) Applicant: Samsung Electronics Co., Ltd., Gyeonggi-do (KR)

(72) Inventors: Hoon Park, Seoul (KR); Ho-Saeng Kim, Gyeonggi-do (KR); Yeon-Woo Kim, Seoul (KR); Seong-Tae Jeong, Gyeonggi-do (KR); Sang-Min Han, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 197 days.

(21) Appl. No.: 14/101,550

(22) Filed: Dec. 10, 2013

(65) Prior Publication Data

US 2014/0292589 A1 Oct. 2, 2014

(30) Foreign Application Priority Data

Mar. 28, 2013 (KR) ..... 10-2013-0033475

(51) Int. Cl.
*H01Q 1/24* (2006.01)
*H01Q 1/38* (2006.01)

(52) U.S. Cl.
CPC ..... *H01Q 1/243* (2013.01); *H01Q 1/38* (2013.01)

(58) Field of Classification Search
CPC ..... H01C 1/243; H01C 1/38
USPC ..... 343/702
See application file for complete search history.

(56) References Cited

U.S. PATENT DOCUMENTS

2008/0136716 A1* 6/2008 Annamaa ..... H01Q 1/22 343/702
2009/0167631 A1* 7/2009 Tai ..... H01Q 1/22 343/906
2011/0115679 A1* 5/2011 Kong ..... H01Q 1/243 343/702
2011/0193752 A1* 8/2011 Wang ..... H01Q 1/243 343/702
2012/0182201 A1* 7/2012 Guo ..... G06K 19/07 343/906
2012/0280989 A1 11/2012 Birtwistle et al.

* cited by examiner

*Primary Examiner* — Dameon E Levi
*Assistant Examiner* — Walter Davis
(74) *Attorney, Agent, or Firm* — Cha & Reiter, LLC

(57) ABSTRACT

An antenna device of a portable device such as a smartphone includes a connecting member having a conductive case and mounted on a circuit board of the portable device in a manner such that the case is connected to a ground surface of the circuit board; a radiator spaced from the circuit board; and at least one connecting pin provided between the case and the radiator. The radiator is connected to the ground surface through the connecting pin and the case. The antenna device advantageously may be easily installed in the internal space of a miniaturized, lightened and/or slimmed portable device by practically using a conductive component, e.g., the case, of the connecting member.

16 Claims, 7 Drawing Sheets

ANTENNA FOR PORTABLE DEVICE

CLAIM OF PRIORITY

This application claims priority under 35 U.S.C. §119 a Korean Application Serial No. 10-2013-0033475, which was filed in the Korean Intellectual Property Office on Mar. 28, 2013, the entire content of which is hereby incorporated by reference.

BACKGROUND

1. Technical Field

The present disclosure relates generally to a portable electronic device, and particularly to a built-in antenna of a portable device.

2. Description of the Related Art

A portable terminal (portable device) is generally considered any hand held electronic device capable of receiving and/or transmitting an information or communication signal. Today's ubiquitous portable devices such as smartphones typically perform a variety of function such as voice communication, short message transmission, a multimedia function such as playing music or reproducing video, and an entertainment function such as a game. Such portable terminals may be classified into various types considering specialized functions and portability thereof. For example, portable terminals are classified into a bar-type, a folder-type, a slider type, etc. based on external appearances thereof.

As the multimedia function has expanded, a recent trend is to configure portable terminals with a large display. In addition, as the degree of integration in electronic devices has increased and high capacity and ultra high speed wireless communication is popularized, a myriad of functions are integrated in a typical portable terminal. However, with the larger displays, when considering the portability, miniaturization and lightening of portable terminals are also desirable. Accordingly, in order to maintain ease of portability while increasing the display size, it is required to reduce the thickness of the portable terminal.

Meanwhile, portable terminals have in recent years been designed with a built-in antenna for wireless communication, rather than the protruding antennas of earlier models. In order to achieve a requisite radiation characteristic and suppress interference with other circuit devices, the antenna should be suppressed from interfering with a circuit board, a conductive component or an integrated circuit chip within the portable terminal.

FIG. 1 illustrates an installation structure, 10, of a conventional embedded antenna device of a portable terminal. An antenna device, more specifically, a radiator embedded in the portable terminal, is usually positioned to face a circuit board 11 at least partially. The installation structure 10 of the antenna device is the rear surface of the circuit board 11. In order to minimize the effect of an RF signal transmitted/received through a radiator to other circuit devices, it is desirable to maintain a predetermined gap between the radiator and the other circuit devices. In particular, when a ground surface 13 is provided over a major surface of the circuit board 11, a fill-cut region 15 (i.e., a region that is cut out and then filled) is formed by removing a part of the ground surface 13 on the circuit board 11 as illustrated in FIG. 1 so as to install an embedded antenna device. Typically, a portion of the radiator of the antenna device is disposed over the fill-cut region 15.

In addition, a connecting member 17 of an earphone socket, a universal serial bus (USB) connector, or the like is provided at an edge of the circuit board 11. Such a connecting member 17 is also fabricated to include a metallic material, and especially, a USB connector or the like, which includes connecting terminals arranged densely in the inside thereof, and is protected by a metallic case. FIG. 2 illustrates a connecting member 17, in particular a metallic case portion of the connecting member. When the case of the connecting member 17 is formed of a conductive material, it is desirable to ground the case itself to the ground surface 13 of the circuit board 11.

Even if such a case formed of a conductive material is connected to the ground surface 13, it is desirable to secure a sufficient gap between the circuit board and the antenna radiator. This is because the radiation characteristic of a given radiator varies considerably depending on the installation position, the proximity to other conductive components, and whether nearby conductive components are grounded or not.

Recently, as integrated circuits have been made smaller, the size of a circuit board 11 of a portable terminal has gradually decreased. The smaller size makes it more difficult to achieve a requisite connecting member mounting space, a fill-cut region 15 for disposing an antenna device, and so on. Accordingly, as illustrated in FIG. 1, the connecting member 17, more specifically, the case of the connecting member 17, is sometimes inevitably disposed on the fill-cut region 15 of the circuit board 11.

However, such an arrangement of the connecting member may limit a space or region 19 where an antenna device may be installed. That is, the flexibility in designing an antenna device is seriously degraded. Further, it is necessary to keep portable terminal thickness to a minimum in order to miniaturize and lighten the portable terminals as the sizes of displays increase, and the ability to provide a built-in antenna device capable of achieving a stable radiation performance has reached a limit. In addition, when a plurality of antenna devices are installed in a single terminal in order to use various types of communication standards, for example, mobile communication, WLAN (Wireless Local Area Network), Bluetooth™, and NFC (Near Field Communication), arranging all the antenna devices inside the portable terminal is even more challenging.

SUMMARY

Accordingly, an aspect of the present invention is to provide an antenna device capable of providing a stable radiation performance when installed internally within a miniaturized and lightweight portable device.

Another aspect is to provide an antenna device capable of improving the flexibility of design inside a portable device by using a connecting member within the portable device, in particular, a connecting member case of a conductive material.

Further, still another aspect is to provide an antenna device capable of efficiently using an internal space of a portable device by using a connecting member case installed within the portable device as a ground connection path to the radiator.

An antenna device of an electronic device according to various embodiments includes a connecting member having a conductive case and mounted on a circuit board of the electronic device in a manner such that the case is connected to a ground surface of the circuit board. A radiator is spaced from the circuit board. At least one connecting pin is provided between the case and the radiator. The radiator is connected to the ground surface of the circuit board through the connecting pin and the case.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION

Hereinafter, various embodiments of the present invention will be described with reference to the accompanying drawings. In the following description, a detailed description of known functions and configurations incorporated herein will be omitted to avoid obscuring the subject matter of the present invention.

The inventive antenna device of a portable terminal (equivalently, "portable device") is configured such that a radiator is spaced from a circuit board and connected to a ground surface of the circuit board through a connecting member such as a USB connector, more specifically, through a conductive case of the connecting member. A connecting pin, for example, a flexible member can be provided between the radiator and the case to ensure a stable connection between the case and the radiator.

According to an exemplary embodiment, the connecting pin may be mounted on the case or provided by processing a part of the case. Alternatively, the connecting pin may be mounted on the radiator or mounted on a carrier installed on the radiator. Further, an intermediate member of a conductive material may be disposed between the case and the radiator so as to ensure the stable contact of the connecting pin.

When the inventive antenna device is provided with an intermediate member, the connecting pin may be mounted on the case to be in contact with the intermediate member or mounted on the intermediate member to be in contact with the case. The intermediate member is electrically connected to the radiator. In addition, when the inventive antenna device is provided with the intermediate member, the connecting pin may be mounted on the radiator to be in contact with the intermediate member or mounted on the intermediate member to be in contact with the radiator.

Figure 3:
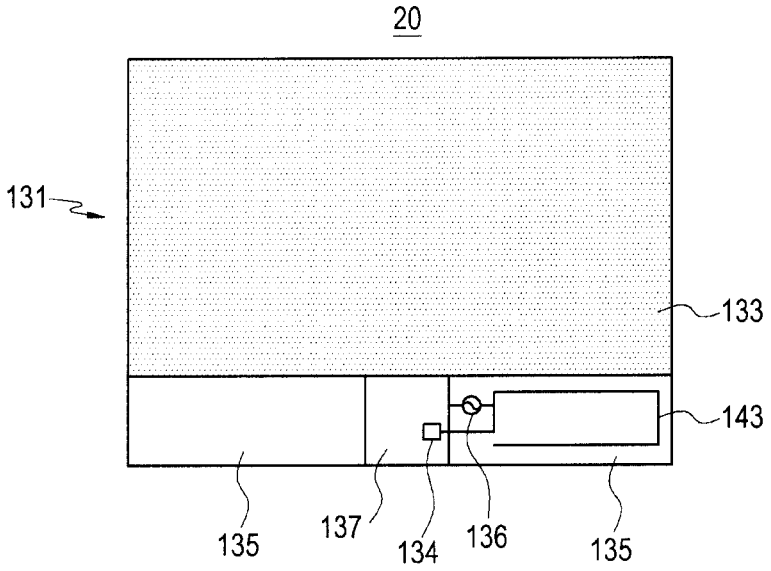
FIG. 3 is a view for describing an installation structure of an embedded antenna device of a portable device according to an exemplary embodiment of the present invention.
Figure 4:
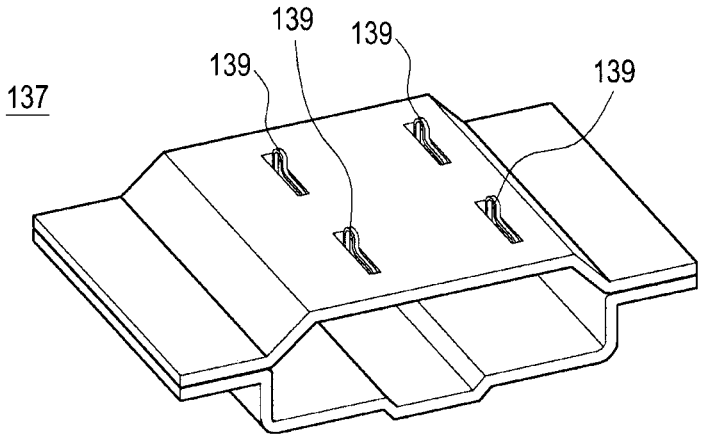
FIG. 4 is a perspective view illustrating a connecting member case mounted on a circuit board of a portable device illustrated in FIG. 3.
Figure 5:
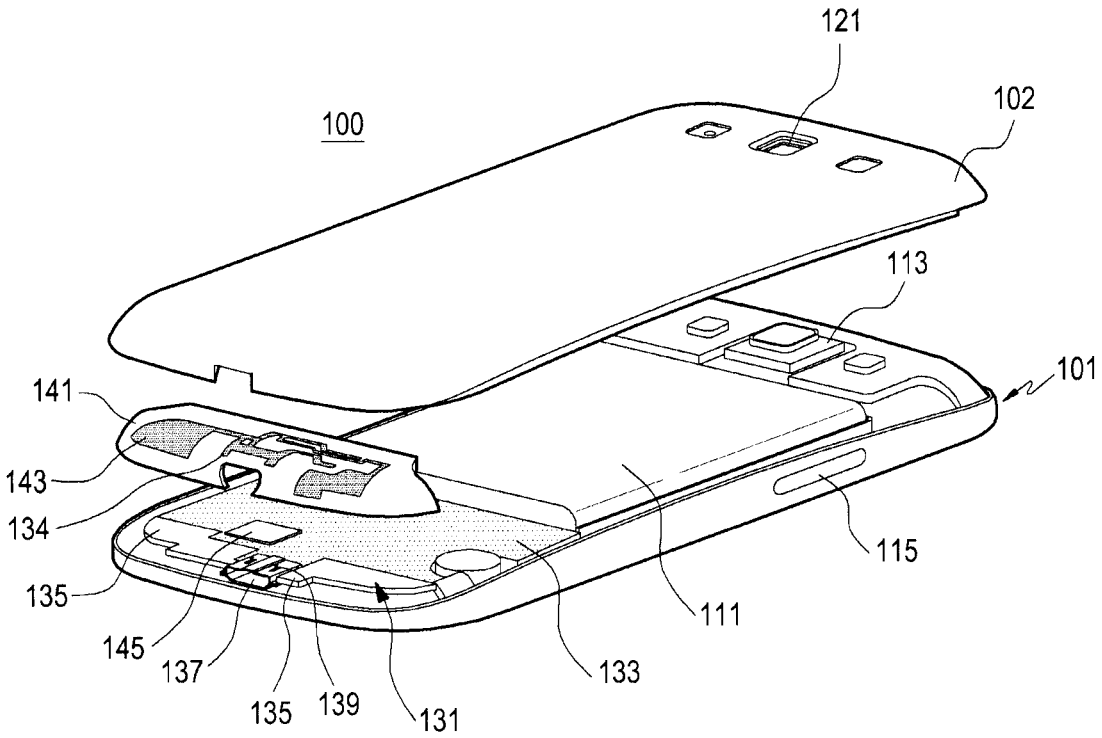
FIG. 5 is an exploded perspective view illustrating a portable device in which the antenna device installation structure illustrated in FIG. 3 is implemented.

FIG. 3 is a view for describing an antenna device installation structure 20 of a portable device 100 (see FIG. 5) according to an exemplary embodiment of the present invention. Installation structure 20 can be considered a bottom surface (i.e., the surface opposite mounted circuit components) of a circuit board 131. FIG. 4 is a perspective view illustrating a connecting member 137, in particular the case of the connecting member (without showing internal connecting structure) mounted on a circuit board 131 in the antenna device installation structure 20 illustrated in FIG. 3. FIG. 5 is an exploded perspective view illustrating a portable device 100 in which the antenna device installation structure 20 illustrated in FIG. 3 is implemented.

Referring to FIGS. 3 to 5, the example portable device 100 is a bar-type device having a single housing. Portable device 100 can be any electronic device capable of receiving and/or transmitting an information or communication signal. Examples of portable device 100 include but are not limited to a smartphone, a tablet PC, a camera device, a music player, and a broadcast receiver. A display device, a receiver module or the like which is not illustrated in the drawings is disposed on the front surface of the housing 101, and a side key 115 for use in adjusting volume or scrolling a menu is installed on a side surface. A detachable cover 102 is provided on the rear surface of the housing 101, such that when the cover 102 is removed from the housing 101, a detachable battery pack 111, a camera module 113 or the like is revealed. Typically, the cover 102 is provided to protect the battery pack 111 or the like. However, the cover 102 may be formed with openings 121 to provide a photographing route of the camera module 113 and to output sound from a speaker. The camera module 113 is positioned at the upper side of the battery pack 111 mounted on the housing 101, and the circuit board 131 of the portable device 100 is located at the lower side of the battery pack 111.

Various integrated circuit chips and the connecting member 137 are mounted on the circuit board 131, and a radiator 143 of an antenna device is spaced from the circuit board 131. This spacing is achieved in the exemplary embodiment by installing the radiator 143 on an outer peripheral surface of a carrier 141 which can in turn be coupled to the housing 101 and optionally secured to circuit board 131. As a result, the radiator 143 is mounted on the housing 101, e.g., via attachment to rear cover 102. The radiator 143 may be connected with a power feeding circuit, as illustrated by 136, provided on the circuit board 131 through a coaxial cable, a connecting terminal or the like. Radiator 143 is also connected at a predetermined point or points 134 to the conductive case of the connecting member 137, as described in more detail later.

It is noted that for the sake of brevity in describing prominent features of the inventive antenna device, FIG. 4 illustrates only the conductive case of the connecting member 137 and omits the internal connecting structure. The internal connecting structure can be a conventional one for a USB or other connector type. Accordingly, it is also noted that in the following detailed description, reference numeral "137" may be used to refer to either the case or the connecting member. The case 137 can be mounted in one embodiment to face one surface of the circuit board 131 (this mounting configuration is not shown). However, in the specific exemplary embodiment illustrated, a configuration is exemplified in which one side edge of the circuit board 131 is cut to form a recess so as to accommodate the case 137.

When the case 137 is mounted to face the circuit board 131, the housing 101 and hence portable device 100 should secure a space sufficient for accommodating the stacked thickness of the case 137 and the circuit board 131. However, as illustrated in FIG. 5, when the case 137 is accommodated in the recess formed in the circuit board 131, the thickness of the overall structure is reduced to just the thickness of the case 137. That is, the mounting structure of the case 137 and circuit board 131 illustrated in FIG. 5 is intended to reduce the thickness of the portable device 100.

As in a conventional circuit board, the circuit board 131 is formed with at least one ground surface 133 to provide a ground, and various circuit elements such as an integrated circuit chip have at least one signal pin connected to the ground surface. In addition, it is preferable for the case 137 to be connected to the ground surface 133. The circuit board 131 of the portable device 100 is configured such that a partial area thereof is not formed with the ground surface in order to install the antenna device, more specifically, to provide a sufficient distance between the ground surface 133 and the radiator 143. Hereinbelow, the region where the ground surface 133 is not formed on the circuit board 131 is referred to as a "fill-cut region 135".

The radiator 143 integrated with carrier 141 can be positioned on the circuit board 131 and disposed to correspond to the fill-cut region 135. The radiator 143 may be configured by a radiator pattern (conductor pattern) formed by cutting, for example, a copper sheet, or a radiator pattern fabricated using a flexible printed circuit board. Such radiator pattern may be attached and fixed to an outer peripheral surface of the carrier 141. For this attachment, an adhesive, double-sided tape or the like may be used. Also, when the radiator pattern is obtained by machining a metal sheet such as a copper sheet, the radiator pattern may be mounted on and fixed to the outer peripheral surface of the carrier 141 using a dual-injection process or a welding protrusion formed on the outer peripheral surface. In addition, if it is possible to deposit a metallic material such as copper or gold on the outer peripheral surface of the carrier 141, the printed circuit pattern may be directly formed on the outer peripheral surface to be used as the radiator 143.

Meanwhile, it will be appreciated that, as illustrated in FIG. 5, the circuit board 131 is embodied within portable device 100 in a limited size, e.g., occupying a minority portion of the general planar area of device 100. Accordingly, when a conductive component, for example, the connecting member case 137 is disposed on the circuit board 131, the fill-cut region 135 may be used to conserve space. In a conventional design, since the distance between the connector case 17 (FIG. 1) and a radiator needs to exceed a certain minimum distance, the degree of design freedom for the radiator is degraded as described above.

However, the inventive antenna device connects the conductive component, for example, the case 137 to the radiator 143 to use an extension part of the radiator 143 in a practical manner, thereby enabling a more flexible design of the radiator 143.

Figure 11A:
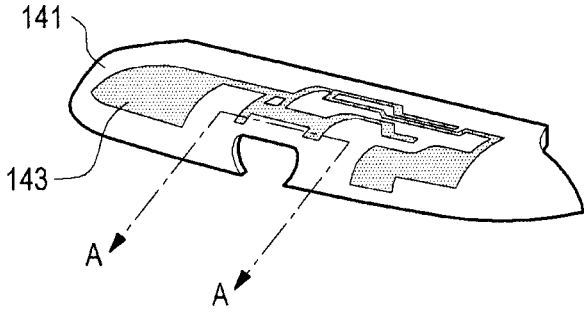
FIG. 11A is a perspective view of an example radiator integrated with a carrier.
Figure 11B:
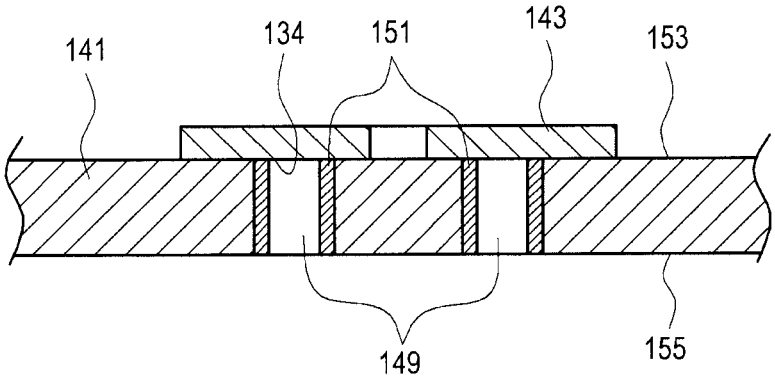
FIG. 11B is a cross-sectional view of the radiator/carrier of FIG. 11A along the lines A-A.

Referring to FIG. 4 again, it will be appreciated that connecting pins 139 are provided on the outer peripheral surface of the case 137. The connecting pins 139 protrude from the outer peripheral surface of the case 137 and are positioned to face the carrier 141. The radiator 143 can be configured to extend to an inner peripheral surface of the carrier 141 so that a part of the radiator 143 is positioned to correspond to the connecting pins 139. For instance, FIG. 11A shows the radiator 143/carrier 141 in isolation and FIG. 11B is a cross-sectional view of the radiator 143 integrated with carrier 141 along the lines A-A of FIG. 11A. Via holes 149 can be formed in carrier 141 and the walls plated with conductive material 151 to effectively extend radiator 143 from an outer peripheral surface 153 of the carrier 141 to an inner peripheral surface 155 thereof. Either one or more of these via holes 149 can be used as a connection point 134 to connect either directly to the connecting pins 139, or indirectly through a conductive intermediate member 145 discussed below. In the embodiment of FIG. 4, four connection pins 139 are employed, thus it may be preferable to provide four corresponding via holes 149 for respective connection to the pins.

Accordingly, when the carrier 141 is mounted on the housing 101, the connecting pins 139 come into contact (directly or indirectly) with a part of the radiator 143. Thus, the radiator 143 is electrically connected to the case 137 through the connecting pins 139. At this time, the case 137 may have been already mounted on the circuit board 131 and already connected to the ground surface 133. Consequently, the radiator 143 is connected to the ground surface 133 through the connecting pin 139 and the case 137.

As a result, the case 137 of a conductive material may be used as an extension part of the radiator rather than as a restriction element that would be need to be a minimum distance away from the radiator as in the prior art. Accordingly, the degree of design of the radiator 143, and further the antenna device may be improved, and the internal space of the portable device 100 may be efficiently used. It is noted here, that the connection of the point or points 134 to the ground surface through at least the connecting pins 139 and case 137 can be deemed a short circuit stub for the purpose of introducing a reactance to improve a matching condition of radiator 143. Thus the particular design of the radiator 143 can be tailored flexibly so that the shorting stub is located at a point where the overall matching condition is improved.

Figure 11C:
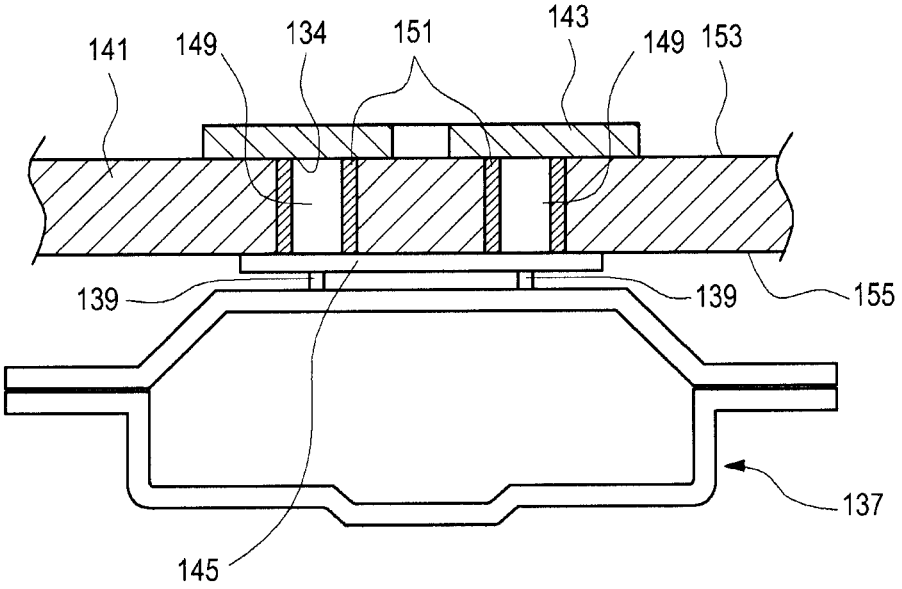
FIG. 11C is another cross-sectional view of the radiator/intermediate member/carrier of FIG. 11A along the lines A-A.

Meanwhile, as illustrated in FIG. 5, the antenna device of the portable device 100 may further include an intermediate member 145 of a conductive material in order to ensure the stable contact between a connecting pin 139 and the radiator 143. Referring to FIG. 11C, It is desirable that the intermediate member 145 is mounted on the inner peripheral surface 155 of the carrier 141 to be electrically connected with the radiator 143. The intermediate member 145 may be fabricated from various materials, for example, a metallic sheet such as a copper sheet and a conductive rubber. The connecting pin 139 has a forcible contact structure like a C-clip or other type of spring.

Figure 11D:
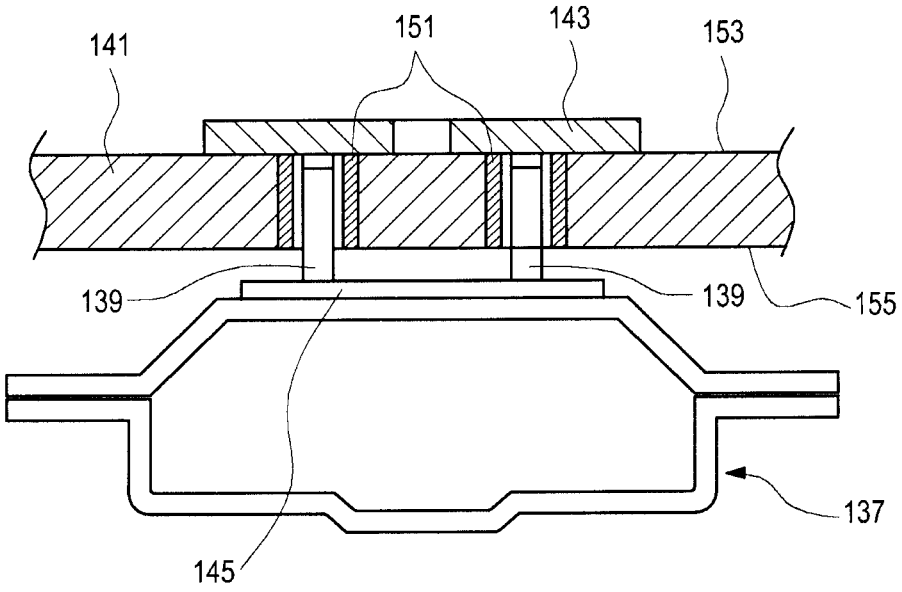
FIG. 11D is further cross-sectional view of the radiator/intermediate member/carrier of FIG. 11A along the lines A-A.

A part of the radiator 143 may be positioned on the inner peripheral surface of the carrier 141 in a state where it extends through the carrier 141 (as in FIG. 11B) or wraps around an edge of the carrier 141 (the latter condition is not shown). Accordingly, the intermediate member 145 may be directly connected with the radiator 143 on the inner peripheral surface 155 of the carrier 141 as illustrated in FIG. 11D.

When the carrier 141 is mounted on the housing 101, the connecting pin 139 protruding from the outer peripheral surface of the case 137 comes into contact with the intermediate member 145 to form an electrical connection.

Meanwhile, the positions for installing the connecting pin 139 and the intermediate member 145 may be variously changed. For example, the connecting pin 139 may be alternatively mounted on a part of the radiator 143 on the inner peripheral surface 155 of the carrier 141. In this case, the intermediate member 145 may be attached to the outer peripheral surface of the case 137. However, when the case 137 itself forms a flat surface on the outer surface thereof, the connection pin 139 installed on the inner peripheral surface of the carrier 141 may be stably contacted with the case 137 even if the intermediate member 145 is not attached. That is, the intermediate member 145 can be omitted in this implementation. In still another implementation, the connecting pin 139 may be mounted on the intermediate member 145. That is, the intermediate member 145 may be mounted on the inner peripheral surface of the carrier 141 and the connecting pin 139 may be mounted on the intermediate member 145. Further, the intermediate member 145 may be positioned between the case 137 and the carrier 141 rather than being mounted on and fixed to the carrier 141. In this case, it is desirable that connecting pins such as C-clips may be mounted on the opposite surfaces of the intermediate member 145 to be connected to the case 137 and the radiator 143, respectively.

Figure 6:
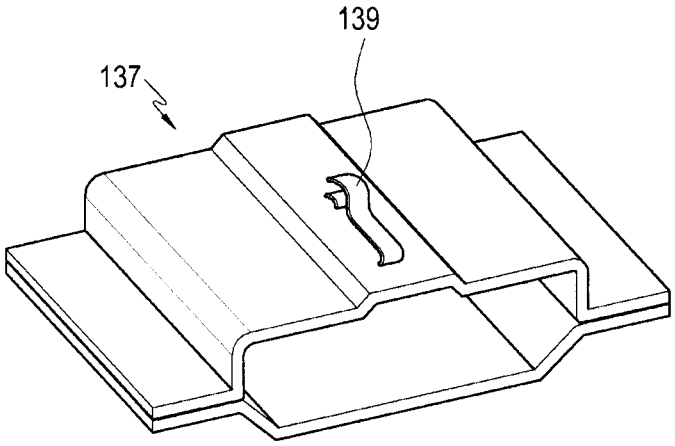
FIG. 6, FIG. 7, and FIG. 8 illustrate modified examples of the case illustrated in FIG. 4, respectively.
Figure 7:
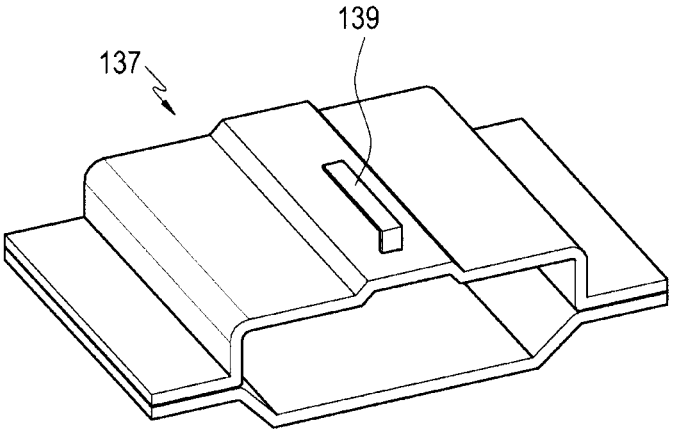
Figure 8:
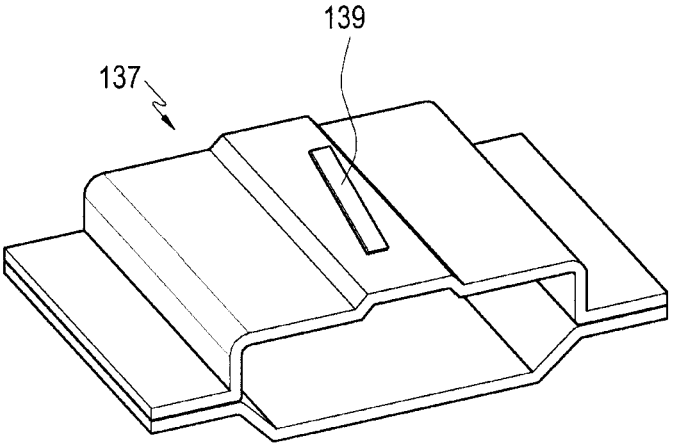

FIGS. 6 to 8 show various possible alternative shapes of the connecting pin 139. The connecting pin 139 illustrated in FIG. 6 is a typical C-clip in which at least a part thereof is bent to form a curvilinear surface. In FIG. 6, at least a part of the connecting pin 139, for example, the part bent to form the curvilinear surface protrudes to the outer peripheral surface of the case 137. When the connecting pin 139 is contacted with the radiator 143 or the intermediate member 145 on the inner peripheral surface of the carrier 141, the connecting pin 139 will be deformed such that the bent curvilinear surface approaches to the outer peripheral surface of the case 137 and makes good electrical contact.

FIG. 7 illustrates a configuration in which the connecting pin 139 protrudes from the outer peripheral surface of the case 137 and is bent at least once so that at least a part of the connecting pin 139 extends in parallel to the outer peripheral surface of the case 137, or is inclined with respect to the case 137 outer surface, thereby facing the outer peripheral surface of the case 137. FIG. 8 illustrates a configuration in which the connecting pin 139 extends from the outer peripheral surface of the case 137 as an inclined linear tab, thereby protruding from the case 137.

As described above, the shape of the connecting pin 139 may be variously changed. In addition, the connection pin 139 is not necessarily installed on the case 137, but may be on the intermediate member 145 or extend from the radiator 143 as described above.

Figure 1:
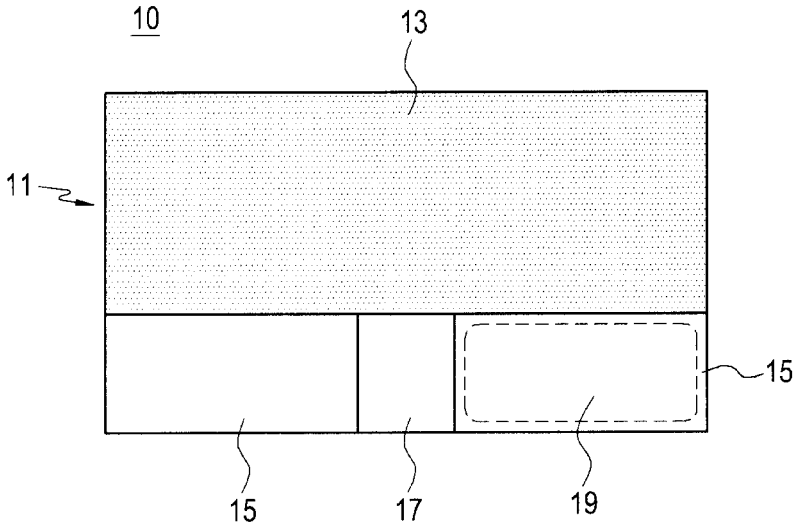
FIG.1 (RELATED ART)
FIG. 1 is a view for describing an installation structure of a conventional embedded antenna device of a portable terminal.
Figure 2:
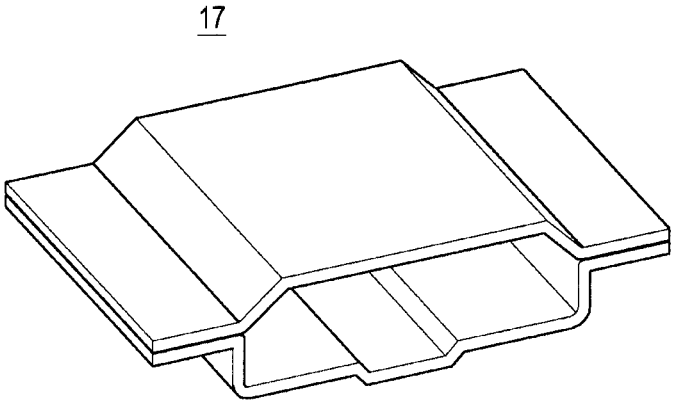
FIG.2 (RELATED ART)
FIG. 2 is a perspective view illustrating a connecting member case mounted on a circuit board of a portable terminal illustrated in FIG. 1.
Figure 9:
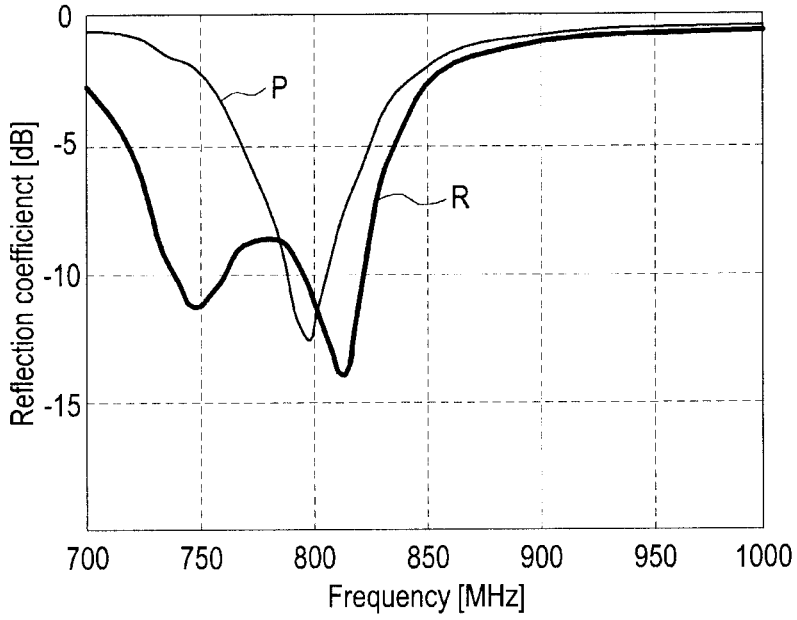
FIG. 9 is a graph representing reflection coefficients measured for the conventional embedded antenna device illustrated in FIG. 1 and the antenna device illustrated in FIG. 5.
Figure 10:
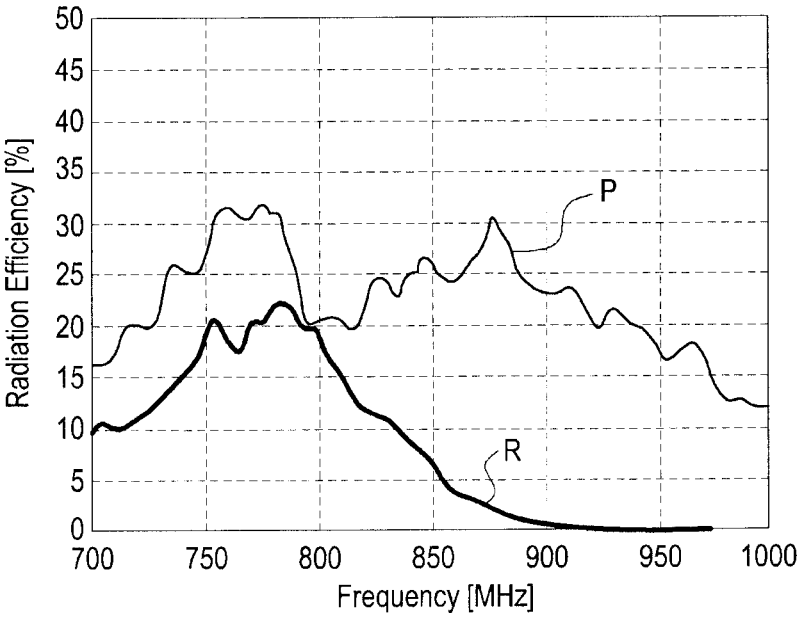
FIG. 10 is a graph representing radiation efficiencies measured for the conventional embedded antenna device illustrated in FIG. 1 and the antenna device illustrated in FIG. 5.

FIGS. 9 and 10 are graphs representing reflection coefficients and radiation efficiencies measured for an antenna device implemented in a structure as illustrated in FIG. 1 and an antenna device implemented in a structure as illustrated in FIG. 5, respectively. The present inventors performed these measurements so as to confirm the possibility of the inventive antenna device to be commercially available when compared to the conventional antenna device is already commercially available. In addition, it is noted that since the graphs illustrated in FIGS. 9 and 10 are obtained by measuring the antenna devices which were fabricated in different conditions, the performances of the antenna devices may not be directly compared with each other.

As illustrated in FIG. 9, the reflection coefficient P of the inventive antenna device reveals a characteristic of resonating at the frequency band of about 800 MHz. The reflection coefficient R of the conventional and commercially available embedded antenna device reveals a characteristic of resonating at the frequency bands of about 750 MHz and about 810 MHz. Now, in the inventive antenna device, two or more resonance frequency bands may also be secured according to the shape and pattern of the radiator or when a plurality of the radiators are disposed. As illustrated in FIG. 10, the radiation efficiency P is 20% or more over a relatively broad frequency band. Consequently, it is seen that the inventive antenna device may secure a radiation efficiency considerably better than the radiation efficiency R of the currently commercially available antenna device.

That is, it is seen from the above-described measurement results that the inventive antenna device may secure a stable operation characteristic at least equivalent to a conventional commercially available antenna device of a portable terminal or the like which is currently commercially available. Further, the inventive antenna device uses a conductive connecting member case as an extension part of a radiator and thus, may contribute to the efficient usage of the internal space of the portable terminal. That is, the design may free up space for other components, or allow the overall device to be made smaller. Although the conventional embedded antenna devices should be designed with a sufficient gap from a conductive case or the like, the inventive antenna device does not require such a gap. Accordingly, it is possible to secure a space for installing an antenna device flexibly while reducing the installation space of the antenna device or within the same space.

An antenna device configured as described above has an advantage in that it may be easily installed in the internal space of a miniaturized and lightened portable device and further in the internal space of a miniaturized, lightened and slimmed portable device by practically using a conductive component of a connecting member mounted on a circuit board, for example, a conductive case as a part of a connecting member (e.g., USB, etc.). That is, since it is not necessary to ensure a gap between the radiator and the conductive component, the degree of design freedom of an antenna device may be improved and the internal space of a portable device may be efficiently used.

While the present invention has been shown and described with reference to certain embodiments thereof, it will be understood by those skilled in the art that various changes in form and details may be made therein without departing from the spirit and scope of the present invention as defined by the appended claims. For example, while the invention has particular applicability to portable devices, application to fixed electronic devices is also contemplated.

What is claimed is:

1. An antenna device of an electronic device, comprising:

a connecting member having a conductive case which is electrically connected to a ground surface of a circuit board;

a radiator spaced from the circuit board; and at least one connecting pin mounted on the case or provided as a part of the case while protruding from one surface of the case and coming into contact with one surface of the radiator to make an electrical connection therebetween, wherein the radiator is connected to the ground surface of the circuit board through the at least one connecting pin and the case.

2. The antenna device of claim 1, wherein at least a part of the connecting pin is bent to form a curvilinear surface, and protrudes from the one surface of the case.

3. The antenna device of claim 1, wherein the connecting pin extends inclined from the one surface of the case.

4. The antenna device of claim 1, wherein the connecting pin is bent at least once while protruding from the one surface of the case, thereby partially facing an outer peripheral surface of the case.

5. The antenna device of claim 1, wherein the connecting pin is formed by cutting and bending a part of the case, so as to protrude from the one surface of the case.

6. The antenna device of claim 1, further comprising:

a carrier mounted to face the circuit board, wherein the radiator is a radiation pattern provided on an outer peripheral surface of the carrier and at least a part of the radiator extends to an inner peripheral surface of the carrier.

7. The antenna device of claim 6, further comprising:

an intermediate member of a conductive material provided between the inner peripheral surface of the carrier and the case, wherein the radiator is connected to the intermediate member on the inner peripheral surface of the carrier and the connecting pin is mounted on the one surface of the case to come into contact with the intermediate member, thereby connecting the radiator to the ground surface through the intermediate member, the connecting pin and the case.

8. The antenna device of claim 6, further comprising:

an intermediate member of a conductive material provided on the inner peripheral surface of the carrier, wherein the radiator is connected to the intermediate member on the inner peripheral surface of the carrier and the connecting pin is mounted on the intermediate member to come into contact with the case.

9. The antenna device of claim 6, wherein the radiator is one of a printed circuit pattern formed on an outer peripheral surface of the carrier, a radiator pattern formed by a conductive plate, or a flexible printed circuit board and attached to an outer peripheral surface of the carrier.

10. An electronic device comprising:

a circuit board having a ground surface;

an antenna device including:

a connecting member having a conductive case which is electrically connected to the ground surface;

a radiator spaced from the circuit board; and at least one connecting pin mounted on the case or provided as a part of the case while protruding from one surface of the case and coming into contact with one surface of the radiator to make an electrical connection therebetween, wherein the radiator is connected to the ground surface of the circuit board through the at least one connecting pin and the case.

11. The electronic device of claim 10, further comprising:

a carrier mounted to face the circuit board, wherein the radiator is a radiator pattern provided on an outer peripheral surface of the carrier and at least a part of the radiator extends to an inner peripheral surface of the carrier for connection to the case.

12. The electronic device of claim 10, wherein the electronic device is a smartphone.

13. An electronic device comprising:

a circuit board having a ground surface;

an antenna device including:

a connecting member having a conductive case which is electrically connected to the ground surface;

a radiator spaced from the circuit board; and at least one conductive flexible member mounted on the case or provided as a part of the case while protruding from one surface of the case and coming into contact with one surface of the radiator to make an electrical connection therebetween, wherein the radiator is connected to the ground surface of the circuit board through the at least one conductive flexible member and the case.

14. The electronic device of claim 13, wherein the radiator is disposed above the case, the one surface of the case is an upper surface of the case and the one surface of the radiator is a lower surface of the radiator.

15. The antenna device of claim 1, wherein the radiator is disposed above the case, the one surface of the case is an upper surface of the case and the one surface of the radiator is a lower surface of the radiator.

16. The electronic device of claim 10, wherein the radiator is disposed above the case, the one surface of the case is an upper surface of the case and the one surface of the radiator is a lower surface of the radiator.

* * * * *